United States Patent [19]

Jonsson et al.

[11] 3,969,921

[45] July 20, 1976

[54] METAL BENDING PRESS WITH REMOVABLE UPPER BEAM

[75] Inventors: Finn L. Jonsson, Ystad; Rune G. Adolfsson, Boras, both of Sweden

[73] Assignee: AB Carbox, Ystad, Sweden

[22] Filed: Mar. 31, 1975

[21] Appl. No.: 563,308

[30] Foreign Application Priority Data

Apr. 5, 1974 Sweden ..... 7404632

[52] U.S. Cl. ..... 72/453.06; 72/455; 100/214

[51] Int. Cl.[2] ..... B21J 9/12

[58] Field of Search ..... 72/386, 389, 455, 446, 72/448, 453; 100/214, 269, DIG. 18

[56] References Cited

UNITED STATES PATENTS

| | | | |
|---|---|---|---|
| 3,064,558 | 11/1962 | von Platen | 100/214 |
| 3,316,749 | 5/1967 | Beard | 100/214 |
| 3,422,661 | 1/1969 | Blackhurst | 72/448 |
| 3,450,035 | 6/1969 | Chapman | 100/214 |
| 3,931,728 | 1/1976 | Trolle | 72/455 |

FOREIGN PATENTS OR APPLICATIONS

| | | | |
|---|---|---|---|
| 1,403,554 | 5/1965 | France | 72/455 |
| 1,452,663 | 3/1969 | Germany | 72/455 |

*Primary Examiner*—C.W. Lanham
*Assistant Examiner*—Gene P. Crosby
*Attorney, Agent, or Firm*—Flynn & Frishauf

[57] ABSTRACT

A press for press bending of metal plates comprises two end frames between which are arranged upper and lower beams which between them form a press gap. Each of the end frames preferably comprises two spaced apart columns interconnected at the top and bottom via yokes, the parts being pressed together to form a force-absorbing frame by means of a surrounding tension biased wire bandage. The end portions of the beams are received in the respective spaces formed between the columns of the end frames. In the working position the upper beam is forced towards the upper yokes of the end frames, and in the unloaded state the upper beam is arranged to be laterally movable through the opening in at least one end frame to permit removal and insertion of a workpiece in the press. Hydraulic cylinders are loadably mounted along both sides of the lower beam in order to support a pressing tool which is raisable and lowerable relative to the upper beam by means of the hydraulic cylinders, the hydraulic cylinders being located in registration with force-carrying surfaces of the pressing tool which extend over the length of said pressing tool.

11 Claims, 2 Drawing Figures

METAL BENDING PRESS WITH REMOVABLE UPPER BEAM

This invention relates to a press, and more particularly to a press bending of plates, of the kind comprising two end frames between which are arranged upper and lower beams which between them form a press gap.

Presses of the kind above referred to are utilized for press bending of often very thick plates, which requires heavy forces. When the plates are to be bent into round shells, i.e. into a cylindrical shape, problems arise. The same problem is encountered also in subsequent adjustment bending of plates bent into complete and welded together cylinders. The root of the problem is that if the upper and lower beams are fixed in the end frames of the press, it is impossible to take a cylinder out of or to insert a cylinder into the press. In the primary bending of a plate this problem, as long as it concerns cylinders of relatively small diameter, can be partly eliminated by utilization of a special pressing procedure which is restricted to forming of cylinders for which there is room in the gap between the upper and the lower beam. This procedure is, however, relatively circumlocutory and requires also utilization of an upper tool of particular configuration, which inter alia must be very thin.

It has been proposed earlier that the problems of (i) bending cylinders of such large diameter that the plate will surround the upper beam, and (ii) of being able to adjustment bend such cylinders, could be solved by making the upper beam laterally movable out of the press frame in the longitudinal direction of the beam. This in fact allows workpieces bent into complete cylinders to be easily taken out of and inserted into the press when the upper beam has been moved out towards the side. This gives rise, however, to the problem of attaining sufficient stability of the press frame, since one of the beams cannot then be attached permanently in the side frames. Known arrangements of this kind will therefore be very large and space consuming if they are to be constructed for heavy pressing forces. Moreover they normally require complicated and space-consuming hydraulic equipment for withdrawal and guide of the beam.

An object of the invention is to provide a press of the said kind with a laterally movable beam which can be made for heavy pressing forces while retaining relatively small dimensions.

SUMMARY OF THE INVENTION

The characteristic features of the press according to the invention are that each end frame in a per se known manner comprises two spaced apart columns interconnected at the top and bottom via yokes, the said columns and yokes being pressed together to a force-absorbing frame by means of a surrounding, tension biased wire bandage, the end portions of the beams being received in the respective space formed between the said columns. The upper beam in the working position is forced towards the upper yokes of the end frames and in the unloaded state is arranged to be laterally movable through the opening in one end frame, and the hydraulic cylinder drive means is loadably mounted along both sides of the lower beam so that they support a pressing tool raisable and lowerable by means of said cylinder drive means in line with (i.e., in registration with two force-carrying surfaces extending over the length of the tool.

The use of wire biased end frames allows the frames to be given relatively small dimensions even when these frames are intended to absorb heavy forces. Further, this type of frame makes it possible to achieve simple and sturdy connections between the press beams and the end frames, even when one beam in the unloaded state is to be laterally movable. On account of the shape of the opening formed between the columns included in the end frames, the beams can also be made with an optimal shape from the standpoint of bending stress, i.e. with a large height in proportion to thickness. The lower beam can consequently be of such form that a series of hydraulic cylinders can easily be fitted on each side of the beam for interaction with a raisable and lowerable pressing tool along the entire length thereof, which allows attainment of high pressing forces with utilization of hydraulic cylinders of relatively small dimensions. This arrangement of the hydraulic cylinders also enables the overall length of the press to be reduced. Further, locating the cylinders along both sides of the beam means that when the pressing tool actuated by them consists of a pressing table with two force-carrying surfaces extending over the length of the latter, the said table can be supported in line with the said surfaces, which inter alia means that the thickness of the table can be substantially reduced. The press according to the invention thus permits optimal dimensioning from the standpoint of force carrying of all the parts included therein.

DETAILED DESCRIPTION OF ILLUSTRATED EMBODIMENT

Figure 1:
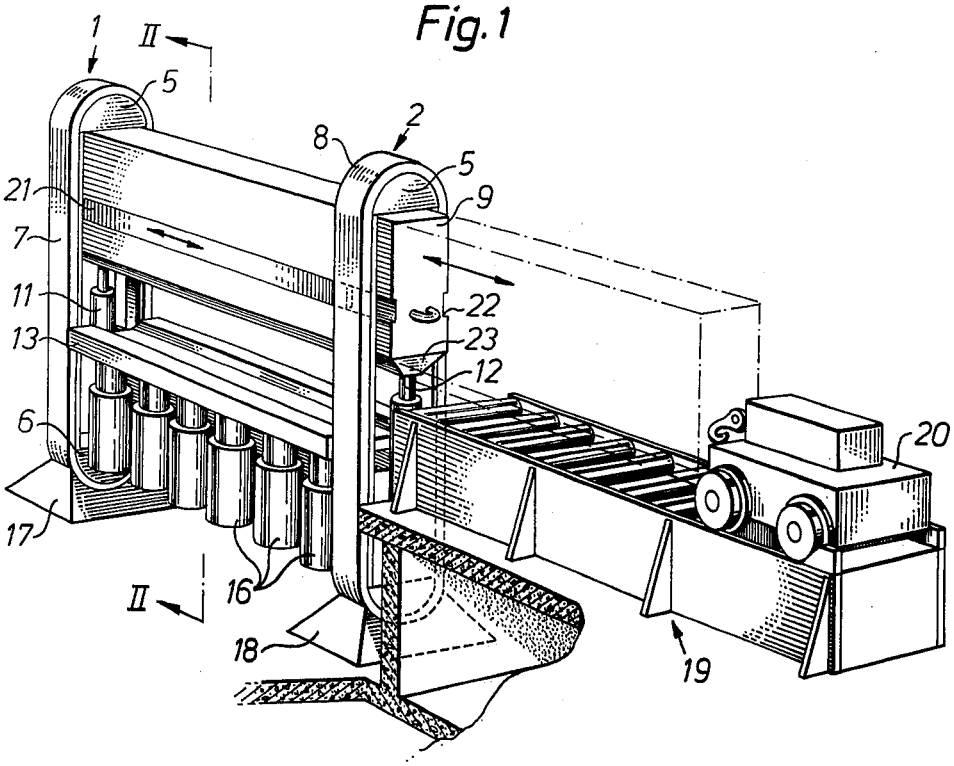
FIG. 1 is a perspective view of a press according to the invention.
Figure 2:
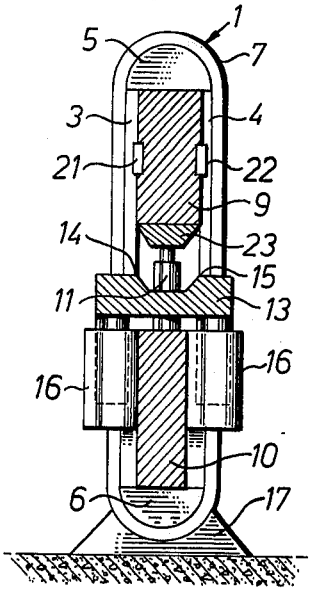
FIG. 2 is a section view through the press according to FIG. 1 along the line II—II in FIG. 1.

The press shown in FIGS. 1 and 2 comprises two end frames 1 and 2 respectively, each of which is built up of two vertical and spaced apart columns 3 and 4 respectively (see FIG. 2) and of an upper yoke 5 and a lower yoke 6 interconnecting the said columns. The yokes and columns are pressed together to form a frame which can absorb very large forces by means of tension biased wire bandages 7 and 8 respectively. The end frames 1 and 2 are interconnected by means of an upper and a lower beam, 9 and 10 respectively. The lower beam 10 is supported by the lower yokes 6 included in the respective end frames, whereas the upper beam 9 which in the working position is forced towards the upper yokes 5 included in the respective end frames by means of hydraulic cylinders 11 and 12 respectively provided in each side frame is laterally movable out through the side frame 2. The hydraulic cylinders 11 and 12 can act directly on the end portions of the lower beam 10 or on booms provided in the respective end frames. For fixing of the upper beam 9 in exactly the correct position during the pressing operations the contact surfaces between the latter and the upper yokes 5 are provided with projections and interacting recesses.

The upper beam 9, which in itself can be made as a pressing tool or provided with grooves or other attachment devices for reception of a suitable pressing tool, cannot be vertically displaced. The lower tool or pressing table 13 with two elongated spaced apart force-carrying surfaces 15 and 16 respectively located symmetrically in relation to the upper tool can, in contrast, be moved towards or away from the upper tool 23. In order to distribute the force acting on the pressing table along the entire length thereof a plurality of hydraulic cylinders 16 is provided on each side of and supported by the lower beam 10. The cylinders 16 are preferably arranged in pairs opposite one another on opposite sides of the lower beam 10 and uniformly distributed along the length of the pressing table. This arrangement makes it possible inter alia to reduce the dimensions of the pressing table while at the same time guaranteeing exactness of the table movement. It is important for the hydraulic cylinders to support the pressing table opposite those surfaces thereof which are subjected to the highest loads. The utilization of a plurality of hydraulic cylinders in the described manner thus results in the possibility of reducing the dimensions of the pressing table and also — in the case of presses intended for very large forces — eliminates the need for very bulky hydraulic cylinders in each end frame.

According to FIG. 1 the entire press is sunk into the workshop floor and rests on the supporting feet 17 and 19 respectively of the end frames 1 and 2. For reception of the upper beam 9 upon protrusion thereof laterally, a roller conveyor 19 is provided at the side of the frame 2. The actual withdrawal of the beam 9 takes place with the aid of a motor-driven trolley 20 which runs on rails, one on either side of the roller conveyor 19. Before the beam 9 can be withdrawn, it must be lowered slightly with the aid of the hydraulic cylinders 11 and 12 for release of the projections located in the contact surface between the beam and the yoke 5. In order to avoid damage to the press frame in connection with withdrawal of the beam 9, the latter is provided along both its sides with a pair of withdrawable rails 21 and 22 respectively. These rails support the left end of the beam upon withdrawal thereof until the centre of gravity of the beam has passed the frame 2, whereupon the said pair of rails can again be pushed into the beam in order to free the space between the two side frames.

In utilizing the described press, a plate cut to suitable size can be inserted in the press suspended from an overhead travelling crane by means of four wire cables. The overhead travelling crane holds the plate against the upper pressing tool which has the configuration of a blunt edge, wherefter the pressing table 13 is moved upwards by means of the hydraulic cylinders 16 and bends the plate around the edge of the upper tool. After this the pressing table is lowered for feeding of the plate a predetermined distance, whereupon a new pressing and bending operation is performed and so on. By this means a cylinder of diameter determined by the tools and the length of the plate can be made, which cylinder will surround the upper beam 9. When bending of the cylinder has been completed the cylinder can easily be lifted away from the press arrangement with the aid of the said overhead travelling crane after the upper beam 9 has been pulled aside with the aid of the trolley 20 as described above. Adjustment of plates bent and welded into complete cylinders can also take place easily in this press, the cylinder then being inserted into the press arrangement with the beam 9 in the withdrawn position. Beam 9 is then pushed in through one end opening of the plate cylinder and into the far side frame, whereafter it is locked in position with the aid of the hydraulic cylinders 11 and 12. Another major advantage of the described arrangement is that the beam 9 can be chosen according to need, so that its vertical extension can be varied in dependence of requisite pressing forces. The end frames can be simply adapted for reception of beams of different dimensions.

We claim:

1. A press, particularly for press bending of plates, comprising:

two spaced apart end frames (1, 2), each of said end frames (1, 2) including two spaced apart columns (3, 4) interconnected at the top and bottom via yokes (5, 6), and a tension biased wire bandage (7, 8) surrounding and pressing together said columns and yokes to form a force-absorbing frame;

upper and lower beams (9, 10) mounted between said end frames (1, 2) with a press gap being formed between said upper and lower beams, end portions of said beams being received in the respective spaces formed between said spaced apart columns of said end frames and said upper beam (9), in its unloaded state, being arranged to be laterally movable relative to said end frames (1, 2) through said space in at least one end frame (2) to permit the removal and reinsertion of a workpiece in the press;

means (11, 12) for forcing said upper beam (9), in the working position thereof, towards the upper yokes (5) of the end frames (1, 2); and hydraulic cylinder means (16) loadably mounted along both sides of said lower beam (10) and including means for supporting a pressing tool (13) which has at least two force carrying surfaces (14, 15) located on respective opposite sides of a longitudinal center line of said lower beam (10) and extending over a substantial length of said pressing tool (13), said hydraulic cylinder means (16) being operable for selectively raising and lowering said pressing tool (13) relative to said upper beam (9), said hydraulic cylinder means (16) being mounted substantially in registration with said force carrying surfaces (14, 15) of said pressing tool (13) for supporting said pressing tool (13) substantially along said force carrying surfaces (14, 15) thereof.

2. A press according to claim 1, wherein said hydraulic cylinder means (16) includes a plurality of hydraulic cylinders (16) uniformly distributed along the length of said lower beam (10) corresponding to the length of said pressing tool (13) and mounted in pairs opposite one another on respective sides of said lower beam (10).

3. A press according to claim 2, wherein said laterally movable upper beam (9) is provided with withdrawable rails (21, 22) engageable with said end frames (1, 2) to support said upper beam (9) during withdrawal thereof.

4. A press according to claim 2, wherein said means for forcing said upper beam (9), in the working position thereof, towards the upper yokes (5) of the end frames (1, 2) comprises at least one hydraulic cylinder (11, 12) provided in the respective openings between the columns (3, 4) of said frames (1, 2).

5. A press according to claim 4, wherein said laterally movable upper beam (9) is provided with withdrawable rails (21, 22) engageable with said end frames (1, 2) to support said upper beam (9) during withdrawal thereof.

6. A press according to claim 1, wherein said means for forcing said upper beam (9), in the working position thereof, towards the upper yokes (5) of the end frames (1, 2) comprises at least one hydraulic cylinder (11, 12) provided in the respective openings between the columns (3, 4) of said frames (1, 2).

7. A press according to claim 6, wherein said laterally movable upper beam (9) is provided with withdrawable rails (21, 22) engageable with said end frames (1, 2) to support said upper beam (9) during withdrawal thereof.

8. A press according to claim 1, wherein said laterally movable upper beam (9) is provided with withdrawable rails (21, 22) engageable with said end frames (1, 2) to support said upper beam (9) during withdrawal thereof.

9. A press according to claim 8, wherein said rails (21, 22) are withdrawable relative to said end frames (1, 2) and are further movable relative to said movable upper beam (9).

10. A press, particularly for press bending of plates, comprising:

two spaced apart end frames (1, 2);

upper and lower beams (9, 10) mounted between said end frames (1, 2) with a press gap being formed between said upper and lower beams; and hydraulic cylinder means (16) loadably mounted along both sides of said lower beam (10) and including means for supporting a pressing tool (13) which has at least two force carrying surfaces (14, 15) located on respective opposite sides of a longitudinal center line of said lower beam (10) and extending over a substantial length of said pressing tool (13), said hydraulic cylinder means (16) being operable for selectively raising and lowering said pressing tool (13) relative to said upper beam (9), said hydraulic cylinder means (16) being mounted substantially in registration with said force carrying surfaces (14, 15) of said pressing tool (13) for supporting said pressing tool (13) substantially along said force carrying surfaces (14, 15) thereof.

11. A press according to claim 10, wherein said hydraulic cylinder means (16) includes a plurality of hydraulic cylinders (16) uniformly distributed along the length of said lower beam (10) corresponding to the length of said pressing tool (13) and mounted in pairs opposite one another on respective sides of said lower beam (10).

* * * * *